US006059202A

United States Patent [19]

Zink et al.

[11] Patent Number: 6,059,202

[45] Date of Patent: May 9, 2000

[54] HIGH PRESSURE LIQUID ROTARY COUPLING WITH SLIP SEAL

[75] Inventors: Gerald P. Zink; John E. Wolgamott; Douglas E. Wright, all of Durango, Colo.

[73] Assignee: Stoneage, Inc., Durango, Colo.

[21] Appl. No.: 09/071,384

[22] Filed: Apr. 30, 1998

[51] Int. Cl.[7] ..... B05B 3/06

[52] U.S. Cl. ..... 239/259; 277/387; 277/407

[58] Field of Search ..... 239/263, 225.1, 239/251, 255, 259, 252, 265.11, 265.15, 214; 277/375, 387, 404–7

[56] References Cited

U.S. PATENT DOCUMENTS

| | | | |
|---|---|---|---|
| 3,904,211 | 9/1975 | Dega | 277/405 X |
| 5,820,130 | 10/1998 | Zakharov | 277/375 X |
| 5,909,848 | 6/1999 | Zink | 239/252 |

*Primary Examiner*—Kevin Weldon

*Assistant Examiner*—Sean P. O'Hanlon

*Attorney, Agent, or Firm*—Maxwell C. Freudenberg; Kenton L. Freudenberg

[57] ABSTRACT

A high pressure liquid sealing connection between two relatively rotatable liquid passage members of a rotary nozzle or a swivel. The connection is formed by two abutting relatively rotatable annular coaxial sealing members forming a high pressure liquid passage between the relatively rotatable members. Both sealing members are carried and kept coaxial by a seal holder carried by one of the relatively rotatable passage members. Both sealing members are forced axially relative to the seal holder by high pressure liquid flow at the sealing connection to maintain a dynamic sealing relationship between the sealing members and to force one of the sealing members into sealing contact with and rotation with the other of the relatively rotatable passage members. As the other sealing member substantially wears away by relative rotation of the sealing members it is forced axially relative to the seal holder and toward the one sealing member to maintain the sealing integrity of the sealing connection.

20 Claims, 3 Drawing Sheets

HIGH PRESSURE LIQUID ROTARY COUPLING WITH SLIP SEAL

BACKGROUND OF THE INVENTION

In the field of high pressure rotary liquid handling devices where the operating parameters can exceed 10,000 psi, rotating speeds of 1,500 rpm and flow rates of 25 gpm, the size, construction, cost, durability and ease of maintenance of rotating seals for such devices present many problems. Combined length and diameter of such devices may not exceed a few inches. The more extreme operating parameters and great reduction in size compound the problems. Pressure, temperature and wear factors affect durability and ease of maintenance and attendant cost, inconvenience and safety in use of such devices. Use of small metal parts such as springs and poor quality of materials in such devices may result in their deterioration or breakage and related malfunctioning seals and jamming of small spray discharge orifices or the like. Simple durable low cost and easily maintained seals are most desirable.

SUMMARY OF THE INVENTION

Among the objects of the invention is to simplify the configuration of wearing parts of a small high pressure spray nozzle seal to reduce the number and cost and facilitate economical manufacture and replacement of the wearable parts.

Another object of the invention is to provide improved operation of rotatable high pressure seals by improving configuration of the sealing parts and eliminating use of small metal springs exposed to high pressure and velocity water flow over such springs heretofore used to hold abutting seal parts in engagement.

Another object of the invention is to help achieve a small durable light weight elongated and small diameter rotating high pressure spray nozzle assembly which can be conveniently carried on the end of a spray lance and readily inserted into small diameter tubes and the like to clean the same as well as being usable on other structures or large flat areas.

Another object of the invention is to provide a rotatable seal in which the sealing integrity is independent of direction and suitable for reversible rotation as in a swivel connection.

The high pressure nozzle seal of this invention is intended for use in a High Pressure (HP) range of approximately 5,000 to 30,000 psi. Thus the seal between a relatively stationary seal holder and the rotating inlet end of a nozzle tube must contain any selected pressure to be used. For a selected pressure, the flow rate and the orientation of the nozzle discharge tips provide the reactive force to rotate the nozzle. With a nozzle speed control means in a protected bearing and speed control chamber to prevent overspeeding, the speed can be selectively kept in the range of about 100 to 1500 rpm for a spraying operation. However without speed control a runaway nozzle can achieve several thousand rpm which not only can detrimentally affect the spraying function but also rapidly increase wear of seals, bearings and other operating parts of the nozzle structure.

Several tandem or stacked radial ball bearings arranged face-to face form axially spaced load distributing bearing means between said shaft and said inner cylindrical surface of the housing body, rotatably support said shaft coaxially within the housing body, and prevent axial movement of the shaft when the shaft is subject to high forwardly directed thrust forces from internal pressures on the seal members.

During assembly of several tandem or stacked radial ball bearings in the bearing chamber, the voids in and around the balls are completely filled and sealed with a non-pressurized viscous silicone liquid. After this chamber is sealed this viscous liquid produces a damping effect on the rotating shaft to restrain the speed at which the shaft rotates. Such speed control can be selected by the viscosity of the viscous liquid and physical configuration of the bearings and their races. The speed control is useful in governing the spray pattern from the spray head as the nozzle assembly is moved by its support relative to an object or surface being sprayed. Also the reduced rotational speed significantly reduces wear and heat generation at the moving parts within the nozzle assembly.

The nozzle structure comprises a generally cylindrical housing body containing a coaxial rotatable tubular shaft member having an input end in sealed relationship with a connecting high pressure liquid input member in the input end of the housing which has an internally threaded portion for receiving the end of a nozzle supporting lance or other means (not shown) for supplying the spray liquid to the spray nozzle.

Between the nozzle input member and the input end of the shaft is a high pressure sealing assembly comprising a stationary annular seal holder opposite to the end of the shaft for supporting annular seal components having inner diameters corresponding to the inner diameter of the input end of the shaft. The seal holder is counterbored to provide a stepped annular recess with a smooth cylindrical wall coaxial with the shaft and containing a plastic annular cylindrical seal member and an annular cylindrical carbide wear resistant hard sealing ring seat which is held between the plastic seal and the end of the shaft when high pressure liquid flows through the nozzle during its spraying operation. The carbide seat is kept coaxial with the shaft by the stepped recess and its forward end projects beyond the recess into sealing engagement with the end of the shaft. The outside wall of the plastic seal fits snugly against the wall of the stepped recess and has an O-ring seal in a longitudinally-central groove between the plastic seal and the wall of the stepped recess to provide additional sealing means therebetween and hold the plastic seal in position against rotation and against the carbide seat as the latter is held against the shaft by pressure of the spray liquid on the plastic seal and rotates with the shaft during operation of the nozzle. As the end of the plastic seal wears where it contacts the carbide seat, liquid pressure on the plastic seal will push it forwardly along the stepped recess to assure continuity of the sealing assembly at the input end of the shaft.

The seal may be made using just the carbide seat and a force fit of the plastic seal member in the smooth cylindrical inner surface of the seal holder, but preferably the addition of a further softer sealing member to prevent flow of the high pressure liquid between the seal member and the cylindrical wall of the seal holder aids significantly in maintaining an excellent seal to contain the high working pressure of the spray liquid and prevent escape of high pressure liquid from the intended liquid flow path into the inlet end of the tubular nozzle member. The seal is made of an extrusion-resistant cross-linked ultra-high molecular weight polyethylene. The additional softer sealing member is preferably an O-ring of resilient tough heat-resistant elastomeric material held in a groove of rectangular cross section machined in the outer cylindrical surface of the seal member midway along its length. When the end of the seal member engaging the inlet end of the seat wears down to near the O-ring groove, the seal can be removed and the seal member reversed and used until the other end of the seal member becomes similarly worn.

The invention permits easy replacement of a single seal with O-ring when it is worn at a small fraction of the cost of replacement of the carbide seat.

An alternative to the O-ring is to place another softer sealing member against the inlet end of the main plastic seal, but such a member is more exposed to the high pressure and high velocity liquid flow and is more easily deformed or displaced thereby.

The sealing assembly comprises the seal holder, the plastic seal and the carbide seat. This provides a very effective seal at low cost because of the simplicity of configuration of these three principal parts and their manner of retention, and replacement when necessary after wear, during the life of the nozzle structure. Wear of 50% of the plastic seal is tolerated without degradation of sealing by this assembly.

The rotational speed control means for the spray nozzle is contained in a sealed chamber which encloses the ball bearing means for rotatably supporting the rotatable tubular member which carries the spray liquid to the nozzle spray head. This chamber is sealed to protect the bearing and speed control mechanisms from any spray liquid which might escape from the spray liquid passages within the nozzle housing.

The sealed bearing-enclosing chamber has an annular forward end seal between the outer surface of the shaft and a necked portion of the forward end of the housing. The rear end of the chamber is sealed by an annular metal ring between the shaft and the housing with a first O-ring seal between the ring and the inner wall of the housing and a shaft seal retained in a coaxial cup-shaped recess between the ring and the rotatable shaft.

The various internal elements in the sealed bearing chamber including the forwardmost ball bearing and the rearwardmost ball bearing are kept in relatively fixed axial positions by a clamping arrangement which pushes all such elements toward the forward end of the housing where the foremost element abuts an inwardly extending housing shoulder.

DESCRIPTION OF THE PREFERRED EMBODIMENT

Figure 1:
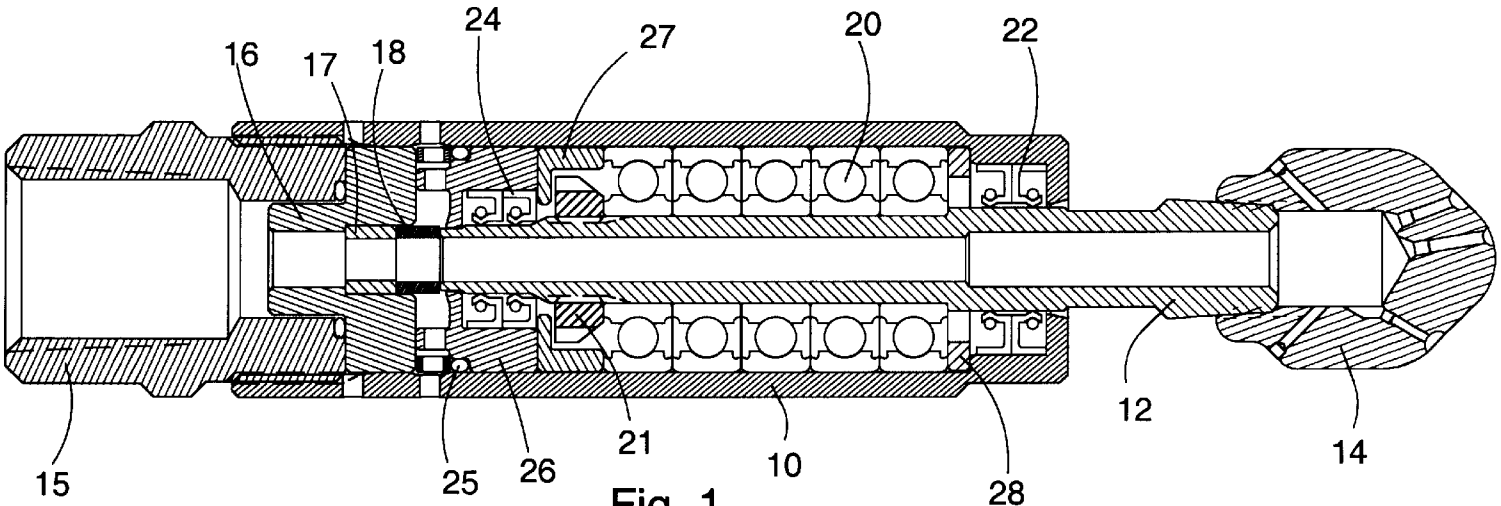
FIG. 1 is a longitudinal section of a high pressure liquid spray nozzle apparatus.

FIG. 1 shows a high pressure liquid nozzle apparatus assembly having an elongated cylindrical nozzle housing body 10 within which is rotatably mounted a coaxial hollow shaft 12 which carries high pressure liquid to a discharge spray head 14 at one end of the body 10 and providing multiple jet streams of the liquid for cleaning purposes and oriented to provide a jet reaction torque on the shaft to make it self-rotating.

High pressure liquid is supplied to the inlet end of the shaft 12 by inlet means comprising an inlet nut 15 which is internally threaded to connect to a source of high pressure liquid (not shown). The inlet nut 15 clamps in place a seal holder 16 within the housing body 10. The seal holder 16 has a stepped coaxial passage presenting a smooth inner cylindrical surface within which are supported an annular cylindrical deformable seal member 17 and an annular cylindrical rigid seat 18 which is held solely by high liquid pressure on the seal member 17 and on the seat to force the latter the against the inlet end of the shaft 12. The sealing seat member 18 has a first end face beveled at its outer edge and abutting the shaft with an area of contact smaller than an area where its opposite end face abuts the seal member 17 whereby the pressure differential across the seat 18 due to the high pressure liquid in said inlet passage maintains a net force holding the seat 18 against the shaft during operation of the apparatus.

Figure 4:
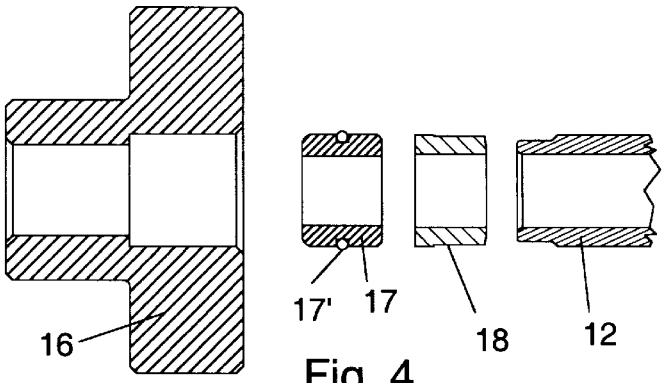
FIG. 4 is an enlarged exploded view of the preferred embodiment of high pressure seal components used in the nozzle of FIG.1.

As seen most clearly in FIG. 4 the seal member 17 has an elastomeric O-ring 17' in a central circumferential groove in its outer surface. The seal member 17 is made of durable strong wear resistant deformable extrusion-resistant material such as a cross linked ultra-high molecular weight polyethylene.

The shaft is rotatably supported in the housing body 10 by means of a stack of abutting coaxial tandem radial ball bearings 20. These bearings have inner and outer races, and preferably have ball cages to increase the internal shearing of viscous fluid by further interaction therewith by the cages in the vicinity of the balls. The inner races are clamped together against a shoulder on the shaft by an inner race retainer 21 screwed on the shaft near its inlet end. The bearings are sealed in a chamber between the shaft 12 and the body 10. Ends of this chamber are defined by a front shaft seal 22 between the shaft 12 and the body 10 and a rear shaft seal 24 engaging the shaft and supported within an annular seal sleeve ring 26 and held in the sleeve 26 by a rear seal retainer 27. Further sealing of the chamber is achieved by the O-ring 25 around the sleeve 26. The outer races of the bearings 20 are clamped together against a front shaft seal retainer 28 which abuts an inner annular shoulder near the front of the body 10. This clamping is achieved during assembly when a forward face of the inlet nut 15 is screwed tightly into the body 10 and against a stack of components including seal holder 16, the seal sleeve 26 and the rear seal retainer 27.

During assembly of the nozzle apparatus the bearing chamber is filled to immerse the bearings in a viscous liquid which is subject to shearing forces by the bearing and other relatively moving surfaces within the bearing chamber. Speed control is maintained by internal viscous shear.

The viscous liquid may have different viscosities such as 500, 2,000 or 12,500 centistokes. It may be a silicone material. A suitable viscous material is polydimethylsiloxane (inhibited) available under a product designation L-405 from OSi Specialties, Inc., in Danbury Conn.

It is desirable to insure that the torque produced by the jets is within the operating limits of the tool. The preferred tool operational torque range is from 4 to 10 in-lb and it is generally desirable not to exceed 12 in-lb of torque.

The jet reaction force and nozzle orientation are designed to produce from 4 to 10 in-lb of torque based on pump size. Too small a torque may result in erratic rotation rates or be insufficient to start rotation. Too large a torque will exceed the ability of the tool to govern rotation speed and may cause heat buildup, temperature rise in the viscous liquid, rapid seal wear, and excessive rotation speeds. The tool should not generally be operated at torques above 12 in-lb.

The flow rating of the tool is 1.3 Cv. This means that at 25 gpm the pressure loss through the tool is about 370 psi, while at 50 gpm the loss is about 1480 psi.

Figure 5:
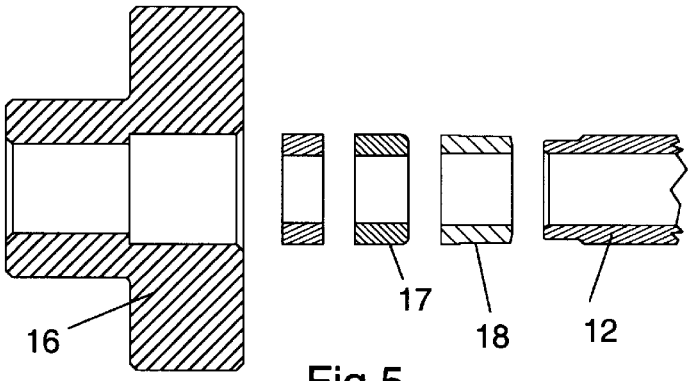
FIG. 5 is an enlarged exploded view of an alternative set of high pressure seal components usable in the nozzle of FIG. 1.
Figure 6:
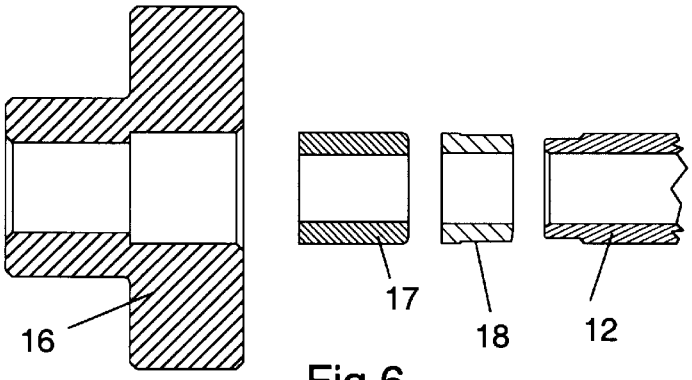
FIG. 6 is an enlarged exploded view of another alternative set of high pressure seal components usable in the nozzle of FIG. 1.
Figure 8:
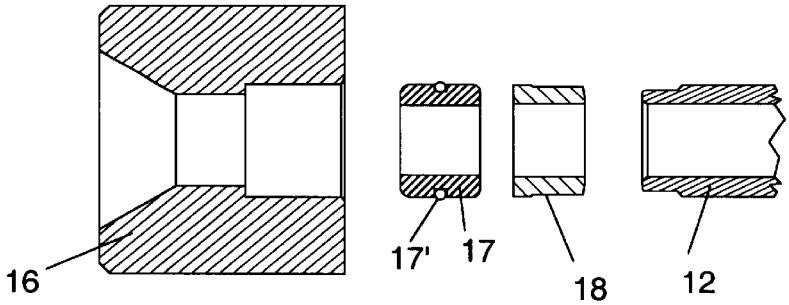
FIG. 8 is an enlarged exploded view of the high pressure seal components of FIG. 7.

In the sets of high pressure sealing components shown in FIGS. 4–6 the sealing seats 18 for sealing against the inlet end of the shaft 12 are identical, as are the seal holders 16.

In FIG. 4 the outside wall of the plastic seal 17 fits snugly against the wall of the stepped recess and has an O-ring seal 17' in a longitudinally-central groove between the plastic seal the stepped recess to provide additional sealing means therebetween and hold the plastic seal in position against rotation and sealed against the carbide seat 18 as the latter is held against the shaft by pressure of the spray liquid on the plastic seal. The seat 18 rotates with the shaft during operation of the nozzle. As the end of the plastic seal 17 wears where it contacts the carbide seat, liquid pressure on the plastic seal will push it forwardly along the stepped recess of the seal holder 16 to assure continuity of the sealing assembly at the input end of the shaft. The importance of the O-ring 17' is to keep high pressure liquid from flowing or leaking around the outside of the plastic seal 17.

In the embodiment of FIG. 5, the O-ring is omitted but high pressure liquid is blocked from going outside of the seal by adding another softer annular cylindrical seal ahead or upstream to seal tightly against the stepped wall of the holder 16 and against the front surface of the seal 17.

Some applications of seals as described herein may be used on oscillating devices where the relative rotation of seal members at a sealing interface must be maintained under high loads created by high pressure liquids. The same sealing function is necessary whether the rotation of a tubular shaft member is continuous or oscillatory.

In the embodiment of FIG. 6, leakage around the seal 17 is minimized by inserting the seal 17 into the seal holder with a tight or press fit. It will still maintain a seal while traveling along the stepped wall of the holder as it wears during operation of the nozzle apparatus.

Figure 7:
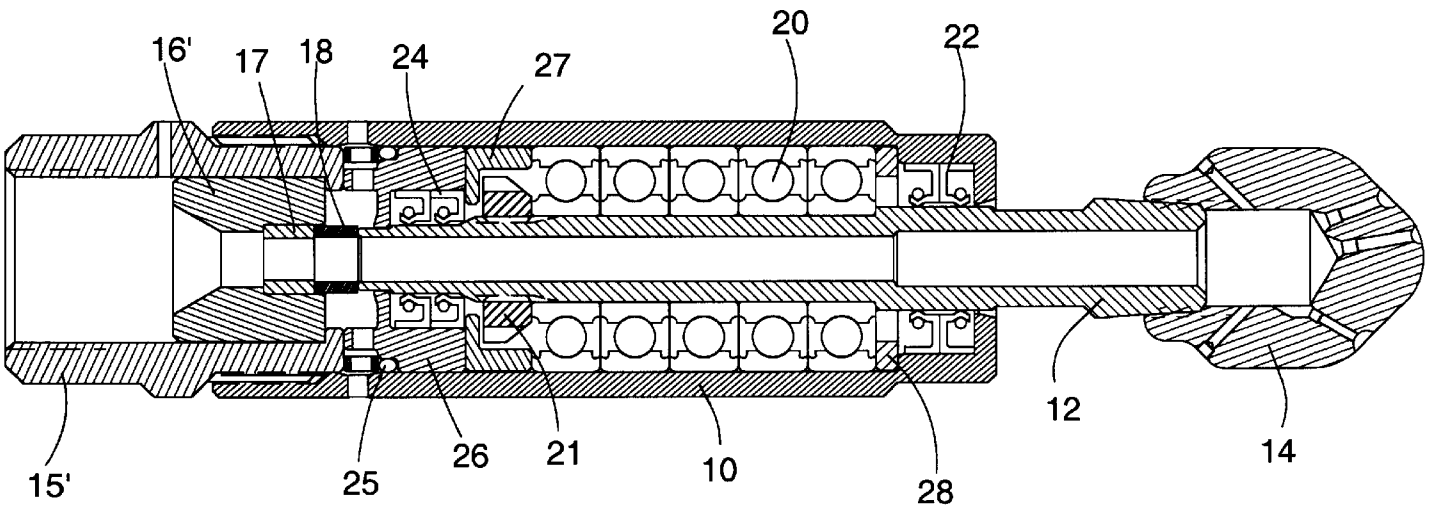
FIG. 7 is a view similar to FIG. 1 of another nozzle apparatus with another embodiment of the high pressure seal.
Figures 2, 3:
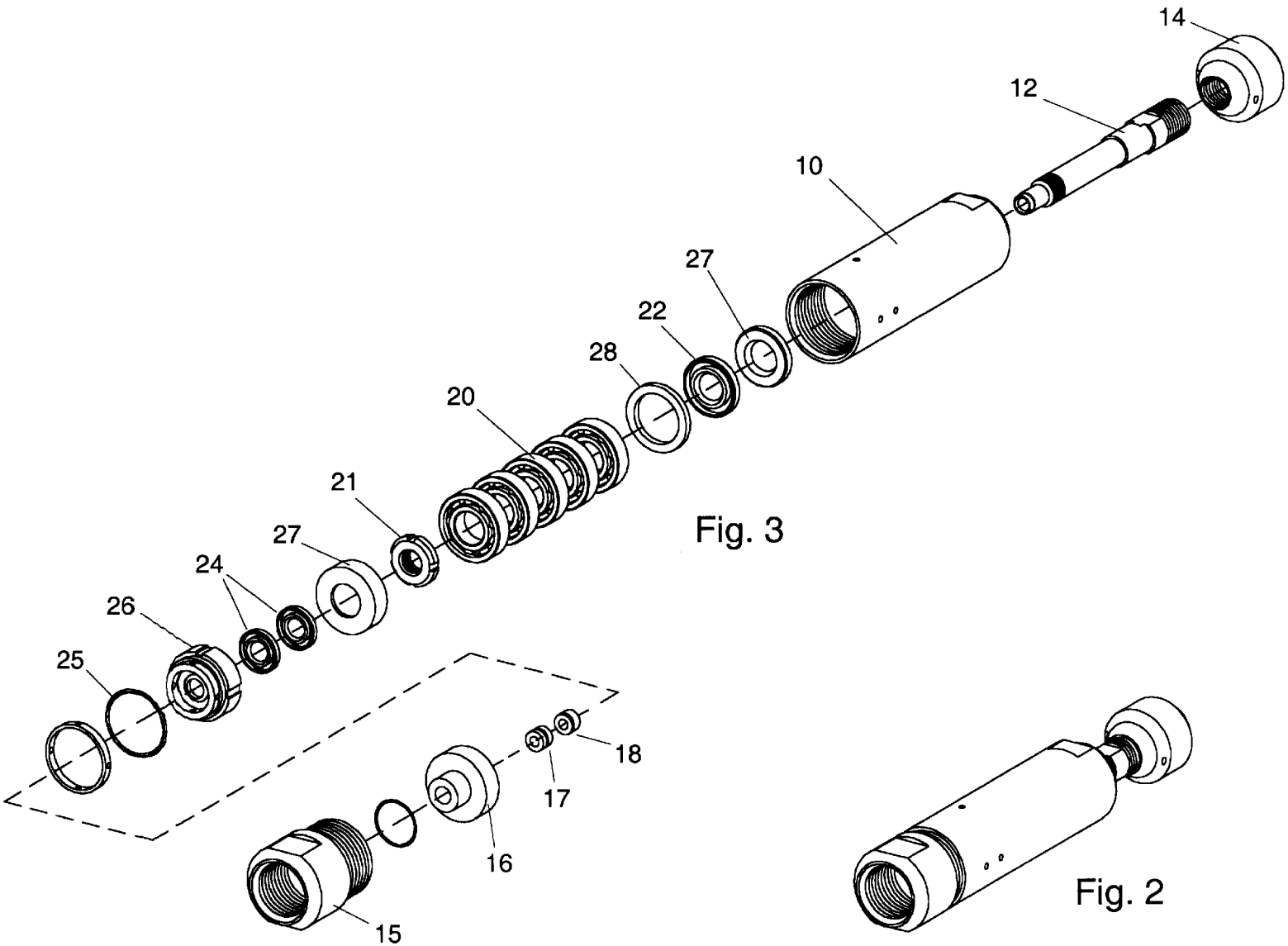
FIG.2 is a perspective view of the nozzle apparatus of FIG. 1 from its inlet end.
FIG. 3 is an perspective exploded view of the nozzle apparatus of FIG. 2.

The viscous liquid retarded nozzle apparatus of FIG. 7 differs from that of FIG. 1 in that the clamped radially outwardly extending flanges of the seal holder 16 are omitted, but the seal holder 16' is clamped in place against a portion of the inlet nut 15' by the attachment of an autoclave coupling on a high pressure liquid hose or lance threaded into the nut 16'. In FIG. 7 as shown, the seal holder 16', the seal 17 and the seat 18 are free to be withdrawn from the nozzle apparatus. Also, the holder 16' has a conical high pressure liquid entrance forwardly tapering to a short reduced diameter cylindrical orifice. Just forward of the orifice is the stepped smooth annular cylindrical seal supporting surface as described for FIG. 1.

A sealed swivel device for insertion into a high pressure liquid line may readily be made from the structure of FIG. 1 by merely connecting the inlet nut to the outlet of one high pressure liquid source line and replacing the spray head with a connection to the inlet of another line which feeds high pressure liquid to, for example, a nozzle apparatus like that of FIG. 1. The integrity of sealing achieved by the present invention is independent of direction and is thus well suited for swiveling in opposite directions. Such a swivel device where the shaft 12 would not continuously rotate with reference to the inlet nut 15 could help avoid twisting and tangling of lines when articulating or reeling them. When used as a mere swivel device, viscous liquid in the bearing chamber could be replaced with a lubricant of low viscosity if viscous shearing for retardation is not needed, and some of the middle bearings could be replaced with spacers if the remaining bearings have adequate load capacity. Alternatively, body 10 could be shortened.

Other variations within the scope of this invention will be apparent from the described embodiments and it is intended that the present descriptions be illustrative of the inventive features encompassed by the appended claims.

What is claimed is:

1. A nozzle assembly for spraying high pressure cleaning liquid against an object to be cleaned and comprising:

a hollow cylindrical housing body, a tubular shaft member rotatable coaxially within the housing body and having a liquid input end within and near one end of said housing body, said shaft member having an output end near a second end of the housing body and including means at said output end for securing a spray head for rotation with the shaft, said body having a high pressure liquid inlet passage, a sealing assembly forming a high pressure sealed passage between the inlet passage of said body and the liquid input end of said shaft, said sealing assembly including a seal holder and first and second seal members, axially spaced bearing means between said shaft and said inner cylindrical surface of the housing body to rotatably support said shaft coaxially within the housing body and to prevent axial movement of the shaft when the shaft is subject to high forwardly directed thrust forces from internal pressures on the seal members, means defining a sealed chamber enclosing said bearing means and a lubricant therefor between said housing body and said shaft, said seal holder being an annular member in fixed relationship to said housing body, said first and second seal members being annular cylindrical members having abutting end faces and coaxial passages aligned with the liquid input end of the shaft, said first seal member being made of a tough extrusion-resistant material, said second seal member being made of hard wear resistant material, said seal holder being located opposite to the input end of the shaft and having a counterbored coaxial cylindrical recess enclosing the first seal member and partially enclosing the second seal member to maintain the seal members and the shaft in coaxial alignment and with the second seal member abutting the shaft in sealing relationship therewith during high pressure spraying operation of the nozzle.

2. A nozzle assembly according to claim 1 wherein said seal members are end-to-end and are forced toward the input end of the shaft only by high pressure liquid in said passage.

3. A nozzle assembly according to claim 1 wherein the second sealing member has a first end face abutting the shaft with an area of contact smaller than an area where its opposite end face abuts the first seal member whereby the pressure differential across the second seal member due to the high pressure liquid in said inlet passage maintains a net force holding said second seal member against the shaft.

4. A nozzle assembly according to claim 3 wherein said second seal member rotates with said shaft.

5. A nozzle assembly according to claim 4 wherein said second seal member rotates relative to and in sealing contact with the first seal member.

6. A nozzle assembly according to claim 1 wherein said seal holder has an outer annular cylindrical surface in sealed engagement with an inner surface of said housing body.

7. A nozzle assembly according to claim 1 wherein said second seal member is a carbide ring and said first seal member is a ring of cross linked ultra-high molecular weight polyethylene.

8. A nozzle assembly according to claim 1 wherein said first seal member can wear away by 50% without degradation of the sealing by said sealing assembly.

9. An elongated slender rotatable coupling assembly having an input end and a relatively rotatable for transferring a high pressure cleaning liquid and comprising:

a hollow cylindrical housing body carrying said input end, a tubular shaft member rotatable coaxially within the housing body and having a liquid input passage within and near one end of said housing body, said shaft member carrying said outlet end near a second end of the housing body, axially spaced bearing means between said shaft and said housing body to rotatably support said shaft near its ends coaxially within the housing body and to prevent axial movement of the shaft when the shaft is subject to high forwardly directed thrust forces from internal pressures on the seal members, means defining a sealed chamber enclosing said bearing means and a lubricant therefor between said housing body and said shaft, input means for transferring a high pressure liquid from said input end into said shaft member in sealed relationship with the input passage of the shaft, said input means including a high pressure sealing assembly within the housing body, said sealing assembly including a seal holder and first and second seal members, said seal holder being an annular member in a fixed axial position within the housing body in spaced relationship to the input end of the shaft, said first and second seal members being annular cylindrical members having abutting end faces and having inside diameters communicating with the liquid input passage of the shaft, said first seal member being made of an extrusion-resistant deformable material, said second seal member being made of hard wear resistant material, said seal holder being located transversely of the input end of the shaft and having a counterbored coaxial cylindrical recess enclosing the first seal member and partially enclosing the second seal member to maintain the seal members and the shaft in coaxial alignment and with the second seal member abutting the shaft in sealing relationship with the input passage of the shaft during high pressure transfer of liquid through the coupling assembly.

10. A coupling assembly according to claim 9 wherein said first seal member can wear away by 50% without degradation of the sealing by said sealing assembly.

11. A coupling assembly according to claim 9 wherein said first seal member is made of cross linked ultra-high molecular weight polyethylene.

12. A dynamic high pressure liquid seal assembly between two relatively rotatable annular members having an axis for their relative rotation, one of said members having an annular sealing face transverse to said axis and coaxial with respect to said axis, the other of said members having a cylindrical seal retaining surface coaxial with said axis facing toward said axis, an annular rigid seat having opposite faces extending perpendicular to said axis and an outer cylindrical surface closely fitting within the cylindrical seal retaining surface of said other member with one of said opposite faces abutting said annular sealing face, an annular deformable seal member having opposite first and second faces extending perpendicular to said axis and an outer cylindrical surface closely fitting within the cylindrical seal retaining surface of said other member with the first of said opposite faces of the seal member abutting said annular sealing face, the second of said opposite faces of the seal member facing a body of high pressure liquid to be contained by said seal to be pressed solely by said liquid to force the seal member into engagement with said seat member and force the seat member into sealing engagement with said annular sealing face of said one member to prevent the high pressure liquid from escaping between said relatively rotatable members.

13. A dynamic high pressure liquid seal assembly according to claim 12 wherein said seat is made of carbide.

14. A dynamic high pressure liquid seal assembly according to claim 12 wherein said seal member is made of cross linked ultra-high molecular weight polyethylene.

15. A dynamic high pressure liquid seal assembly according to claim 12 wherein said annular deformable seal member can wear away by 50% without degradation of the sealing by said seal assembly.

16. A dynamic high pressure liquid seal assembly according to claim 12 wherein said deformable seal member is further provided with an annular sealing ring between a surface of the deformable seal member and the cylindrical seal retaining surface of said other of said members to prevent flow of said high pressure liquid between the seal member and said cylindrical seal retaining surface.

17. A dynamic high pressure liquid seal assembly according to claim 16 wherein said annular sealing ring is in a central groove in the outer cylindrical surface of said deformable seal member.

18. A dynamic high pressure liquid seal assembly according to claim 12 wherein said relatively rotatable members are parts of a liquid conduit structure having a high pressure liquid flow passage containing said axis.

19. A dynamic high pressure liquid seal assembly according to claim 12 wherein said relatively rotatable members are parts of a high pressure spray nozzle having a high pressure liquid flow passage coaxial with said axis.

20. A dynamic high pressure liquid seal assembly according to claim 12 wherein said one of the relatively rotatable members is a rotatable spray nozzle and the other of said relatively rotatable members is a relatively non-rotating housing structure.

* * * * *